US005280914A

United States Patent [19]

Selby et al.

[11] Patent Number: 5,280,914

[45] Date of Patent: Jan. 25, 1994

[54] EDUCATIONAL BOARD GAME

[76] Inventors: Clifton B. Selby, 109 Cliffside Dr., Wilmington, N.C. 28409; Carey J. Burnett, 114 River Oaks Dr., Wilmington, N.C. 28412

[21] Appl. No.: 982,639

[22] Filed: Nov. 27, 1992

[51] Int. Cl.[5] ..... A63F 3/00; A63F 9/18; A63F 1/10

[52] U.S. Cl. ..... 273/287; 273/239; 273/148 A; 273/309; 273/431

[58] Field of Search ..... 273/243, 248, 249–254, 273/239, 198 A, 309, 287, 429–432

[56] References Cited

U.S. PATENT DOCUMENTS

| | | | |
|---|---|---|---|
| 660,384 | 10/1900 | Levings | 273/148 A |
| 2,717,156 | 9/1955 | Nelson | 273/287 |
| 3,462,154 | 8/1969 | Giraud et al. | 273/287 |
| 3,473,809 | 10/1969 | Day | 273/148 A |
| 4,105,202 | 8/1978 | McLaren et al. | 273/309 |
| 4,312,507 | 1/1982 | Smith et al. | 273/287 |
| 4,326,711 | 4/1982 | Giallombardo | 273/142 HA |
| 4,557,485 | 12/1985 | Lardon | 273/249 |
| 4,856,780 | 8/1989 | Begley et al. | 273/244 |
| 4,934,708 | 6/1990 | Kolkind | 273/240 |

FOREIGN PATENT DOCUMENTS

| | | | |
|---|---|---|---|
| 2219744 | 12/1989 | United Kingdom | 273/254 |

OTHER PUBLICATIONS

What's The Word by the Karian Corporation, 1984.

*Primary Examiner*—Benjamin H. Layno

[57] ABSTRACT

A new and improved educational board game is disclosed that employs dice, personal markers, a plurality of two-sided game cards, and a game board. The game board includes indicia, a portion of which corresponds to different levels of difficulty of a predetermined educational category such as history, and a portion of which corresponds to instructions with respect to movement of the personal markers along the game board. The front side of the game card bears a picture of a historical figure, and the back side bears textual information about the historical figure on the front side. During a player's turn, when the player selects one of the game cards, the player looks at the picture on the front side of the selected card. Another player then reads aloud information relating to the picture from the back side of the card. From the information read aloud, the first player learns factual knowledge and makes a guess at the identity of the historical figure in the picture. If the player is correct, the player gets credit for having earned that card. The game cards are grouped into three groups representing three different levels of difficulty which are designated to be undergraduate, graduate, and Ph.D. levels. The game is won by the player who first successfully earns a respective predetermined number of game cards for the respective three levels of difficulty.

4 Claims, 4 Drawing Sheets

EDUCATIONAL BOARD GAME

BACKGROUND OF THE INVENTION

1. Field of the Invention

The present invention relates generally to board games, and more particularly, to a board game especially adapted to award players who demonstrate knowledge of increasing levels of difficulty in a predetermined category.

2. Description of the Prior Art

Board games that test players' knowledge are well known in the prior art. For example, U.S. Pat. No. 4,807,878 of Tripp discloses a trivia game that employs four spinners. The first spinner determines which player is to ask a question. The second spinner determines a challenging player. The third spinner determines the question category; and the fourth spinner determines the point value and the degree of difficulty.

U.S. Pat. No. 4,856,780 of Begley et al discloses a sports trivia game board which employs five differently colored pairs of tokens. The first token tracks a player's progress around the board. The second token keeps score on a scoreboard section of the board. A plurality of colored cubes corresponding to colored spaces on the board are provided. The colored cubes further have indicia corresponding to the questions on each question card. The question a player must answer is determined by first landing on a colored space, then rolling the correspondingly colored cube.

U.S. Pat. No. 4,907,808 of Turner et al discloses a trivia board game associated with the television program Star Trek. The game provides a plurality of knockdown models representing the Enterprise. Players collect model portions and assemble tehm on their game piece while moving from destination to destination on the game board.

U.S. Pat. No. 5,048,842 of Proctor discloses a trivia game system involving recall of trivia information associated with commercial products, commercial slogans, and personalities of characters associated with these products and slogans. Play of the game involves utilization of a playing board which is divided into individual sectors, with each sector including a movement otrack for a progress marker which identifies the winner of the game.

U.S. Pat. No. 5,056,793 of Sigle discloses a picture identification game for competitive determination of the identity of the subject matter of a partially exposed picture, such as a photograph of a well known person. When a participant recognizes the identity of the person in the picture, that participant wins the game.

Thus, while the foregoing body of prior art indicates it to be well known to use board games to test players knowledge in a variety of subject areas, no board game appears to reward a player with victory for cumulatively demonstrating knowledge at a number of sequential levels of difficulty. More specifically, no board game disclosed in the prior art cited above rewards a player with the status of a high level of scholarship for having successfully identified figures in pictures at successively increased levels of difficulty. Moreover, no board game disclosed in the prior art cited above elicits knowledge, from a player, about the identity of a figure in a picture, simply by seeing the picture of the figure and having another player read specific information about the figure. The foregoing disadvantages are overcome by the unique educational board game of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved educational board game that employs dice, personal markers, a plurality of two-sided game cards, and a game board. The game board includes indicia, a portion of which corresponds to different levels of difficulty of a predetermined educational category such as history, and a portion of which corresponds to instructions with respect to movement of the personal markers along the game board. The front side of the game card bears a picture of a historical figure, and the back side bears textual information about the historical figure on the front side. During a player's turn, when the player selects one of the game cards, the player looks at the picture on the front side of the selected card. Another player then reads aloud information relating to the picture from the back side of the card. From the information read aloud, the first player learns factual knowledge and makes a guess at the identity of the historical figure in the picture. If the player is correct, the player gets credit for having earned that card. The game cards are grouped into three groups representing three different levels of difficulty which are designated to be undergraduate, graduate, and Ph.D. levels. The game is won by the player who first successfully earns a respective predetermined number of game cards for the respective three levels of difficulty. A base member may also be provided for supporting the game board and for storing game cards, dice, score cards, and personal markers when the game board is not in use.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved educational board game which has all of the advantages of the prior art and none of the disadvantages.

It is another object of the present invention to provide a new and improved educational board game which may be easily and efficiently manufactured and marketed.

It is a further object of the present invention to provide a new and improved educational board game which is of durable and reliable construction.

An even further object of the present invention is to provide a new and improved educational board game which is susceptible of a low cost of manufacture with regard to both materials and labor, and which accordingly is then susceptible of low prices of sale to the consuming public, thereby making such educational board game available to the buying public.

Still yet a further object of the present invention is to provide a new and improved educational board game that rewards a player with victory for cumulatively demonstrating knowledge at a number of sequentially difficult levels of difficulty.

Still another object of the present invention is to provide an educational board game that rewards a player with the status of a high level of scholarship for having successfully identified historical figures depicted in pictures at successively increased levels of difficulty.

Still another object of the present invention is to provide an educational board game that extends knowledge, to a player, about the identity of a figure in a picture, simply by the player's seeing the picture of the figure and by having another player read aloud specific information about the figure.

These together with still other objects of the invention, along with the various features of novelty which characterize the invention, are pointed out with particularity in the claims annexed to and form a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 2:
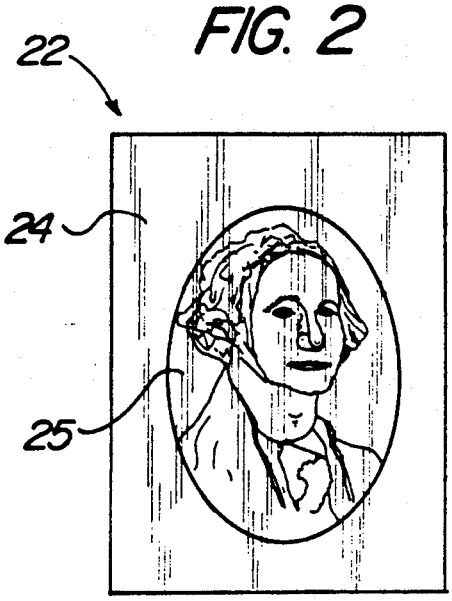
FIG. 2 is a plan view of the front side of a game card used with the embodiment of the educational board game of the invention shown in FIG. 1.
Figure 3:
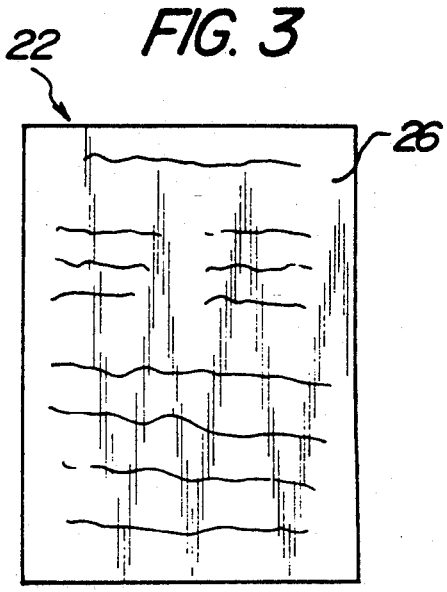
FIG. 3 is a schematic plan view of the back side of the game card shown in FIG. 2.
Figure 1:
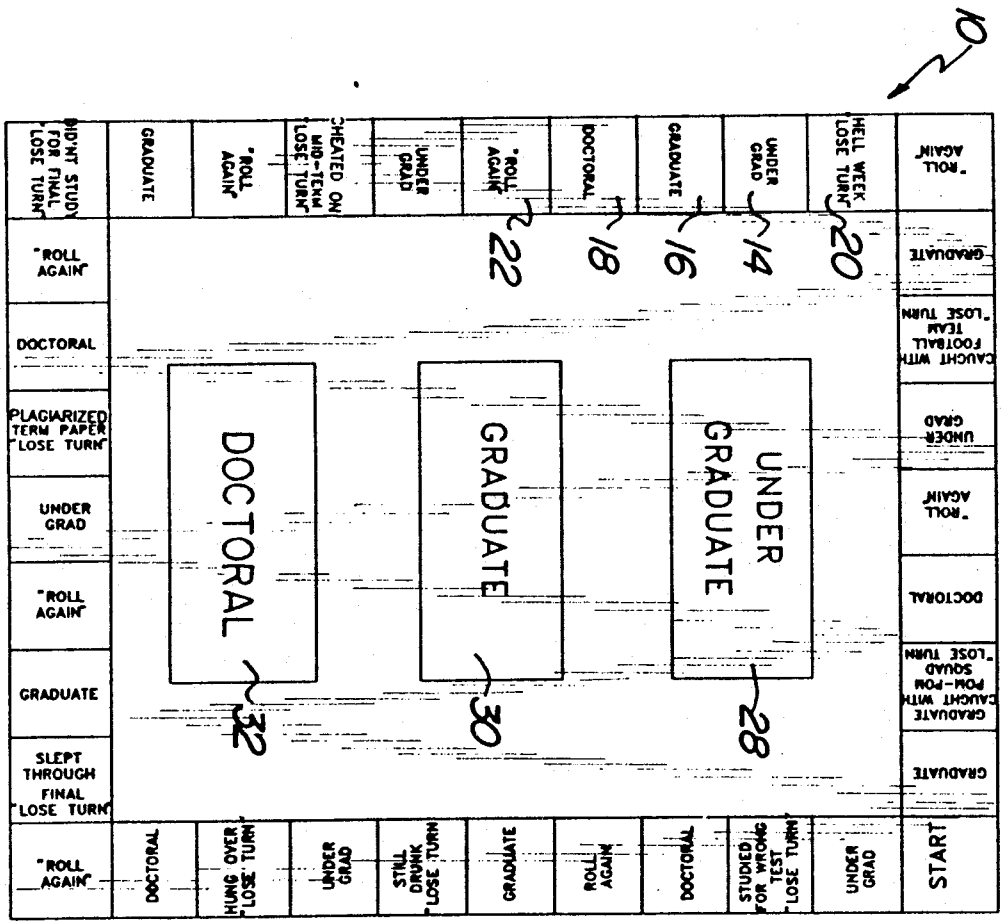
FIG. 1 is a plan view showing a first preferred embodiment of the educational board game of the invention.
Figure 4:
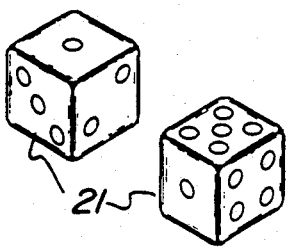
FIG. 4 is a perspective view of a pair of dice used with the embodiment of the educational board game of the invention shown in FIG. 1.
Figure 5:
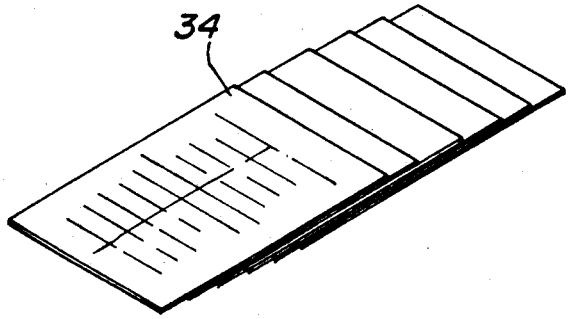
FIG. 5 is a perspective view of a number of score cards used with the embodiment of the educational board game of the invention shown in FIG. 1.

With reference to the drawings, a new and improved educational board game embodying the principles and concepts of the present invention will be described.

Turning initially to FIGS. 1–7, the components of a first exemplary embodiment of the educational board game of the invention are shown. More specifically, the educational board game of the invention includes a game board 10 which includes indicia. A first portion of the indicia corresponds to different levels of difficulty of a category, such as historical figures. The levels of difficulty include undergraduate 14, graduate 16, and doctoral 18. A second portion of the indicia corresponds to instructions with respect to movement of a personal marker 12 (FIG. 7), as determined by chance selection means, e.g. rolling dice 21 (FIG. 4), along the game board 10. Such instructions include: "lose turn" 20; and "roll again" 22.

A plurality of two-sided game cards 22 are employed. A first side 24 (FIG. 2) of a game card 22 bears a picture 25 of an item or person in a chosen category. The first side 24 is the front side 24 of the game card 22. A second side 26 of the game card 22 bears textual information (shown schematically as wavy lines of simulated text) relating to the picture 25 on the first side 24. The second side 26 is the back side 26 of the card.

Figure 6:
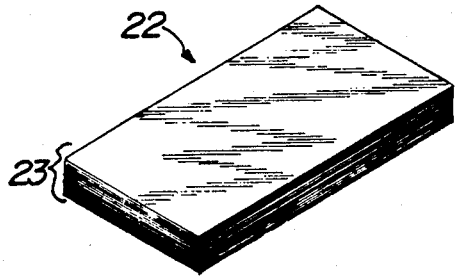
FIG. 6 is a perspective view of a pile of game cards used with the embodiment of the educational board game of the invention shown in FIG. 1.
Figure 7:
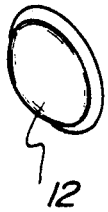
FIG. 7 is a perspective view of a personal marker used with the embodiment of the educational board game of the invention shown in FIG. 1.

Moreover, the game cards 22 are grouped into a plurality of groups corresponding to the different levels of difficulty on the game board 10. That is, a first pile of the game cards 22 includes cards grouped into the undergraduate level of difficulty. A second pile of game cards 22 includes cards grouped into the graduate level of difficulty. And, a third pile of game cards 22 includes cards grouped into the doctoral level of difficulty. A generic pile 23 of game cards 22 is shown in FIG. 6.

In playing the game, each player places a respective personal marker 12 on the "start" block of the game board 10. The players successively roll the dice 21 to see who gets the highest number to take the first turn and go first in actual game play. Then, the player who goes first rolls the dice 21 again and advances the respective personal marker 12 in a clockwise direction along the game board 10 for the number of blocks corresponding to the cumulative number indicated on the top surfaces of the dice 21. For example, the dice 21 shown in FIG. 4 indicate the cumulative number 6.

When the personal marker 12 of the first player lands on a block outlined by the indicia, the first player acts according to the indicia inside the respective block. If the personal marker 12 lands on a block giving instructions about losing or gaining a turn at the dice 21, the first player follows the respective instruction. If the personal marker 12 lands on an undergraduate block, then the first player picks a game card 22 from the pile of undergraduate cards, which would be located in block 28 on the game board 10. If the personal marker 12 lands on a graduate block, then the player picks a game card 22 from the pile of graduate cards, which would be located in block 30 on the game board 10. If the personal marker 12 lands on a doctoral block, then the first player picks a game card 22 from the pile of doctoral cards, which would be located in block 32 on the game board 10.

Each time the first player picks a respective game card 22, he and the other players look at the picture on the front side 24 of the card 22. Then he hands the picked card to a second player who looks at the back side 26.

From this point, a number of alternate protocols are contemplated. In the first protocol, the second player reads aloud a biography from the back side of the card. From the information read from the biography, the first player then guesses who the figure is in the picture 25. This protocol would be especially useful for historical figures whose pictures are not commonly recognized by most people.

In a second protocol, the first player then recites pertinent information about the picture on the front side of the picked card that he hopes corresponds to the textual information on the back side of the card. For example, in the case of the well known figure George Washington, the back side of the card may contain information relating to specific biographical information such as date of birth, place of birth, political affiliation, martial status, and jobs or positions held, among others. If the first player gets a sufficient amount of this information correct, then the first player earns that card.

In a third protocol, the back of the card may contain specific questions with specific answers provided on the card. A second player reads the questions aloud one at a time, and the first player answers the questions one at a time. When the first player provides a predetermined amount of correct answers to the specific questions, then the first player earns the card.

For each protocol, when a player earns a card, he can roll the dice again. However, once a player loses a turn, the next player in succession takes his turn.

For each protocol, the player who first earns the predetermined number of game cards 22 at each level of difficulty is the winner. A record of earning game cards 22 can be recorded on score cards 34 shown in FIG. 5. The score cards 34 can be made from material permitting easy wipe off of records from a crayon or another kind of marker.

In accordance with one specific set of game parameters, the pictures on the cards are those of historical figures. The winner of the game is the first player who earns five undergraduate game cards, four graduate game cards, three doctoral game cards, and one additional game card selected by the other players. The title of tenured professor of history is then conferred upon the winner.

Figure 8:
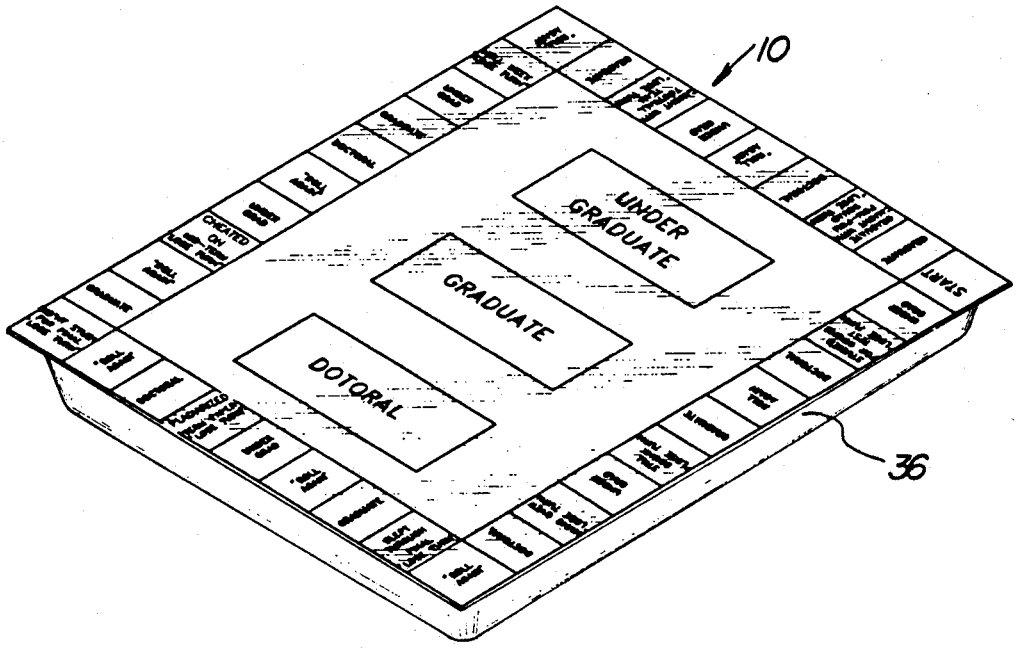
FIG. 8 is a perspective view of a second embodiment of the educational board game of the invention wherein an an alternate educational board game apparatus is provided.
Figure 9:
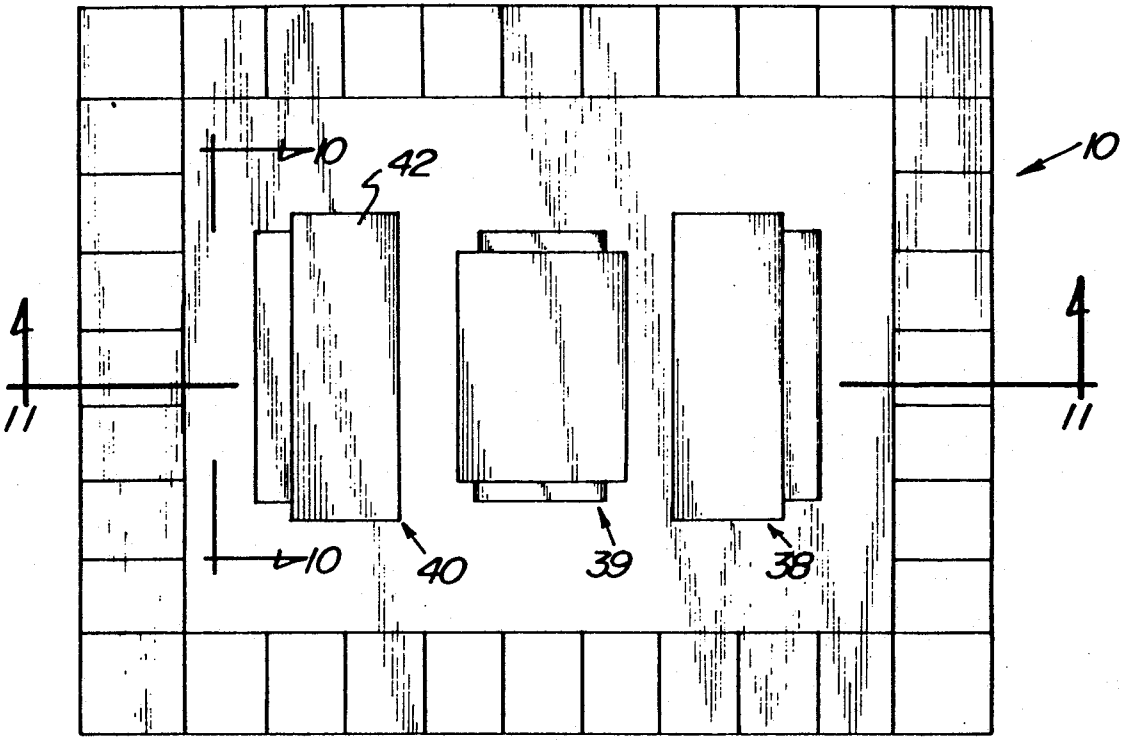
FIG. 9 is a perspective view of a third embodiment of the educational board game of the invention wherein an another alternate educational board game apparatus is provided.
Figure 10:
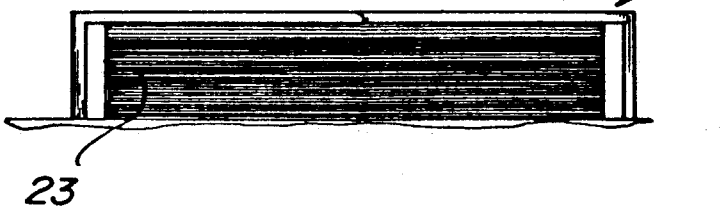
FIG. 10 is a cross-sectional view of the embodiment of the educational board game apparatus of the invention shown in FIG. 9 taken along the line 10—10.

In accordance with another embodiment of the educational board game of the invention, turning to FIG. 8, reference numerals are shown that correspond to like reference numerals that designate like elements shown in the other figures. In addition, FIG. 8 shows a base member 36 which supports the game board 10 and which includes a storage space capable of storing game cards 22, dice 21, score cards 34, and personal markers 12 when the game board 10 is not in use.

In accordance with yet another embodiment of the educational board game of the invention, turning to FIGS. 9–12, reference numerals are shown that correspond to like reference numerals that designate like elements shown in the other figures. In addition, the game board 10 includes special card retainers 38, 39, and 40 for retaining respective piles 23 of game cards 22. The card retainers include a cover member 42 projecting from the top surface 44 of the game board 10 and connected to the game board 10. The cover member 42 includes a vertical portion 46 connected to the game board 10 and a horizontal portion 47 that extends horizontally from the vertical portion 46. The vertical portion 46 provides a clearance 48 between the horizontal portion 47 and the game board 10. Spring guides 50 project from the bottom surface 52 of the game board 10 and are connected to the game board 10. Each of the spring guides 50 includes a top end 54 and a bottom end 56, wherein the top ends 54 are connected to the game board 10. Springs 58 are connected to the spring guides 50 so that bottom ends 60 of the springs 58 are connected to the bottom ends 56 of the spring guides 50.

A movable floor panel 62 spans between the springs 58 and is supported by the top ends 64 of the springs 58. When game cards 22 are added through the clearance 48 to the card retainers 40, a pile 23 of cards is formed, and the pile 23 of cards causes the floor panel 62 to move downward, whereby the springs 58 are compressed and urge the pile 23 of cards 22 toward the horizontal portion 47 of the cover member 42. With this arrangement, when one or more game cards 22 are removed from the pile 23, the remainder of the pile 23 is pushed up into contact with the horizontal member 47 by the springs 58.

Figure 11:
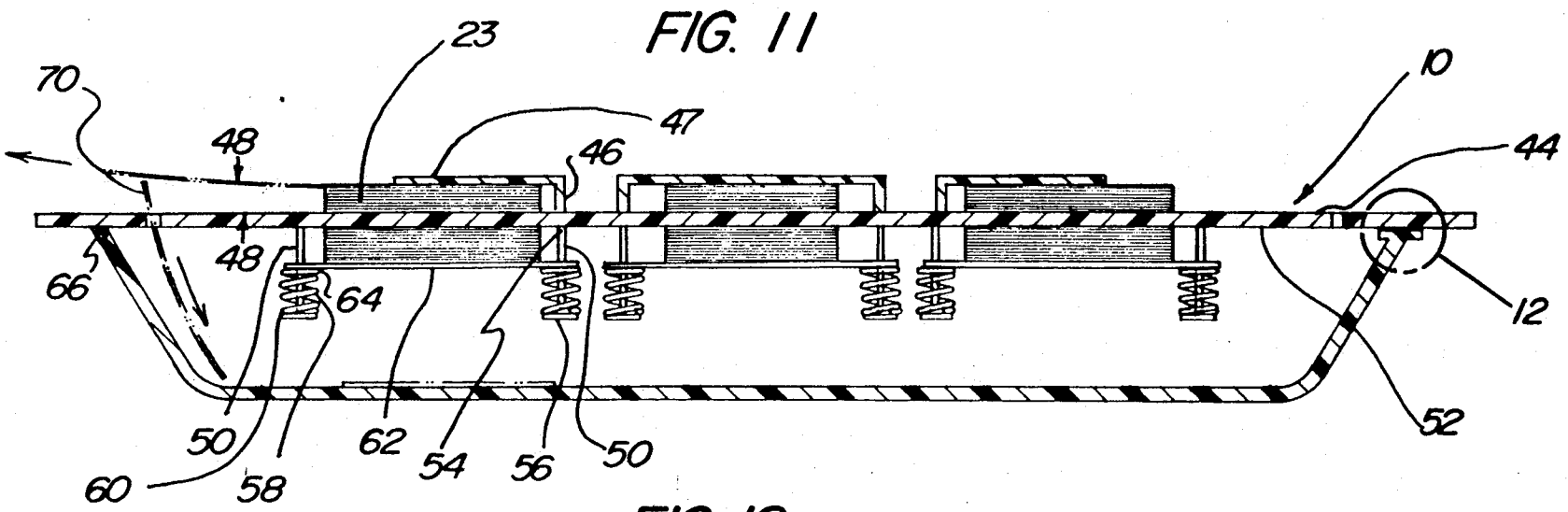
FIG. 11 is a cross-sectional view of the embodiment of the educational board game apparatus of the invention shown in FIG. 9 taken along the line 11—11.
Figure 12:
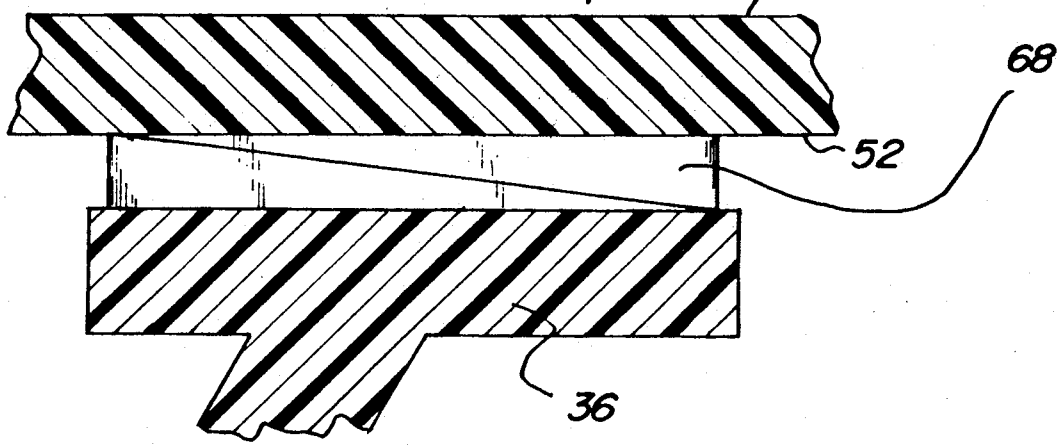
FIG. 12 is an enlarged view of the circled area 12 in FIG. 11.

As shown in FIG. 11, the game board 10 is connected to the base member 36 by hinge 66. In addition, a magnet 68 may be used to secure the game board 10 to the base member 36 so long as either the game board 10 or the base member 36 includes magnetic material. The game board 10 further includes a slot 70 for receiving earned game cards 22 for permitting the earned game cards 22 to enter the base member 36.

The educational board game of the invention can be made from inexpensive materials. The game board and the game cards can be made from paper. The base member can be made from an inexpensive plastic or metal material.

It is apparent from the above that the present invention accomplishes all of the objects set forth by providing a new and improved educational board game and educational board game apparatus that are low in cost, relatively simple in design and operation, and which may advantageously be used to play a new educational board game.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved game board apparatus comprising:

a game board which includes indicia, a portion of which correspond to different levels of difficulty of a category, and a portion of which correspond to instructions with respect to movement of a personal marker along said game board, said game board further including spring-loaded card holders for retaining piles of game cards;

a base member which supports said game board and which includes a storage space capable of storing game cards, dice score cards, and personal markers when said game board is not in use; and means for connecting said game board to said base member, wherein said game board has a top surface and a bottom surface, and said game board further includes means for retaining a pile of game cards, said game card pile retaining means including:

a cover member projecting from the top surface of the game board and connected to the game board, the cover member including a vertical portion connected to the game board and a horizontal portion extending horizontally from the vertical portion, the vertical portion providing a clearance between the horizontal portion and the game board, spring guides projecting from the bottom surface of the game board and connected to the game board, each of the spring guides including a top end and a bottom end, wherein the top ends are connected to the game board, springs, wherein each spring has a top end and bottom end, and wherein each of the bottom spring ends is connected to a bottom spring guide end, and a movable floor panel spanning between the springs and supported by the top spring ends, wherein addition of cards through the clearance causes the floor panel to move downward, whereby the springs are compressed and urge the cards toward the horizontal portion of the cover member.

2. The apparatus described in claim 1 wherein said game board further includes a slot for receiving used game cards for permitting said used game cards to enter said base member.

3. The apparatus described in claim 1 wherein said means for connecting said game board to said base member include a hinge.

4. The apparatus described in claim 1 wherein said means for connecting said game board to said base member include a magnet.

* * * * *